US005091992A

United States Patent [19]

Pusic

[11] Patent Number: 5,091,992

[45] Date of Patent: Mar. 3, 1992

[54] MOTORCYCLIST'S AIR STRIPS

[76] Inventor: Pavo Pusic, 164 McKinley Ave., East Hanover, N.J. 07936

[21] Appl. No.: 451,140

[22] Filed: Dec. 15, 1989

[51] Int. Cl.[5] ..... A41D 13/00

[52] U.S. Cl. ..... 2/2; 2/DIG. 3; 280/733

[58] Field of Search ..... 2/2, 69, DIG. 3; 280/733

[56] References Cited

U.S. PATENT DOCUMENTS

| | | | |
|---|---|---|---|
| 3,905,615 | 9/1975 | Schulman | 280/733 |
| 3,930,667 | 1/1976 | Osuchowski | 2/DIG. 3 |
| 3,948,541 | 4/1976 | Schulman | 280/733 |
| 4,059,852 | 11/1977 | Crane | 280/733 |
| 4,089,065 | 5/1978 | McGee | 2/DIG. 3 |
| 4,685,151 | 8/1987 | Kincheloe | 2/DIG. 3 |
| 4,825,469 | 5/1989 | Kincheloe | 2/2 |

FOREIGN PATENT DOCUMENTS

| | | | |
|---|---|---|---|
| 2717234 | 11/1978 | Fed. Rep. of Germany | 2/2 |
| 2823370 | 12/1979 | Fed. Rep. of Germany | 2/2 |
| 2396521 | 3/1979 | France | 2/2 |
| 2499373 | 8/1982 | France | 2/DIG. 3 |
| 1479733 | 7/1977 | United Kingdom | 2/2 |
| 1503483 | 3/1978 | United Kingdom | 2/2 |
| 1588919 | 4/1981 | United Kingdom | 2/2 |
| 2099687 | 12/1982 | United Kingdom | 2/DIG. 3 |

*Primary Examiner*—Werner H. Schroeder
*Assistant Examiner*—Diana L. Biefeld
*Attorney, Agent, or Firm*—Marks Murase & White

[57] ABSTRACT

Inflatable air strips for protection of a motorcyclist body in case of a traffic accident are disclosed. The air strips comprise plurality of horizontal and vertical air strips worn all around the motorcyclist body which are inflated with gas produced in a gas generator. An inflation process is initiated by an activating cord which is extended from the gas generator and attached to a motorcycle.

20 Claims, 1 Drawing Sheet

MOTORCYCLIST'S AIR STRIPS

BACKGROUND OF THE INVENTION

Generally speaking, riding a motorcycle is a dangerous act. Unlike in the case of a four-wheel vehicle's occupant, a motorcyclist has almost no protective equipment for protecting his/her body in case of any serious accident. Boots, gloves and leather clothing provide the motorcyclist with some protection in case of a minor accident, but because of different reasons, such as weather temperature or current dress fashion, a vast majority of motorcycle riders do not permanently wear these means of protection.

Helmets, which are mandatory equipment in almost any country around the world, are virtually the only equipment which provides satisfactory protection. Unfortunately, the helmet can protect the rider only against head injuries and rest of the rider's body has almost no protection in case of any serious accident.

Since the recent development of air bags, as occupant-restraint means in four-wheel vehicles, undoubtedly increases the safety of a vehicle occupant in case of an accident, it is an object of the present invention to provide a similar device which will ensure better protection for motorcycle riders. It is yet another object of the present invention to provide a device which will be relatively inexpensive, convenient to use, and small in volume.

SUMMARY OF THE INVENTION

The present invention comprises motorcyclist air strips comprising pleated inflatable strips which are worn all around the motorcyclist's body, an inflator unit containing the gas generant, and an activator unit. Since the device is intended to protect the entire motorcyclist's body from neck to heels, it can be attached to helmet and stowed inside the helmet when not in use. It will take only a minute to put on or take off the device which can be worn over any type of garment and will not produce any inconvenience or air resistence. Since the air strips will be easy to put on and off and stored (either in helmet or some other box provided on a motorcycle) it is logical to assume that the vast majority of riders will use the device and, consequently, motorcycle riding safety will significantly increase. The vast majority of motorcycle riders are young people who are very often ready to sacrifice safety because of convenience or fashion and, therefore, it is the object of this invention to provide such means which will not significantly influence riders' convenience or dressing habits and will significantly increase riding safety.

The air strips comprise horizontal and vertical (lateral and longitudinal with respect to the wearer's body) strips which are located around and along the most vital parts of the motorcyclist body. The vertical (or longitudinal) strips are located along the body, arms, and legs while horizontal (or lateral) strips cover the neck, shoulders, elbows, wrists, chest, stomach, hips, knees, and ankles. The horizontal strips are connected on vertical strips and when inflation occurs, gas from the inflator units inflates both vertical and horizontal strips. The inflator units and activator units are located inside the vertical strip which is located along the front part of the motorcyclist torso. The air strips are pleated and sealed on their edges by self-adhesive (velcro) means.

Therefore, they can be packed very compactly in order to require little volume when in stowed condition.

Since in almost any serious motorcycle accident, the motorcyclist separates from the motorcycle and falls on a pavement, gas inflation is activated by the cord which is extended from the activator unit and attached to the motorcycle. When the motorcyclist separates from the motorcycle for a certain predetermined distance the cord activates the inflation process. The gas from the inflator unit then inflates the entire length of the air strips The inflation causes the strips to open and form air tubes all around the motorcyclist's body.

Since the fall of the motorcyclist is in every case much longer than the distance between a steering wheel and occupant's body in a four-wheel vehicle, there will be more time available for inflation process than in the case of an air bag. Therefore, despite the longer distance and more narrow inflation area there will be enough time for the gas to inflate entire length of the air strips before the motorcyclist touches the pavement. As obvious from the above, unlike an air bag unit assembly the air strips do not require a crash sensor and diagnostic unit.

All features and advantages of the present invention will become apparent from the following brief description of the drawings and the description of the preferred embodiment.

DETAILED DESCRIPTION OF THE PREFERRED EMBODIMENT

The present, invention comprises pleated inflatable air strips and an inflator unit 1 containing the gas generant and activator unit. The air strips comprise vertical and horizontal pleated strips which are all either sewn, vulcanized or fabricated together in a manner which allows the flow of gas through their entire length.

The strips are made of a fabric (or some other suitable material) which is coated on its inside surface and hence reasonably non-porous. The fabric has to be resistant enough to sustain a pressure caused by an impact of the motorcyclist's body against a pavement or some other object the motorcyclist may hit during a fall.

Figure 1:
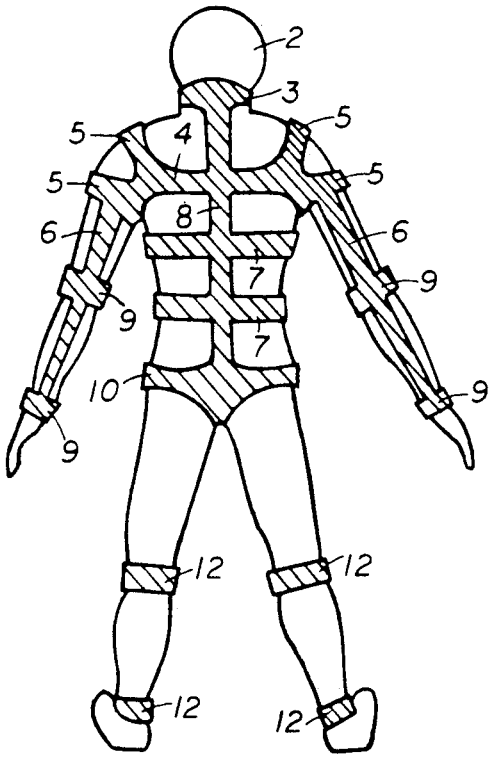
FIG. 1 is the rear side view of the motorcyclist's body showing the arrangement of the uninflated air strips.
Figure 2:
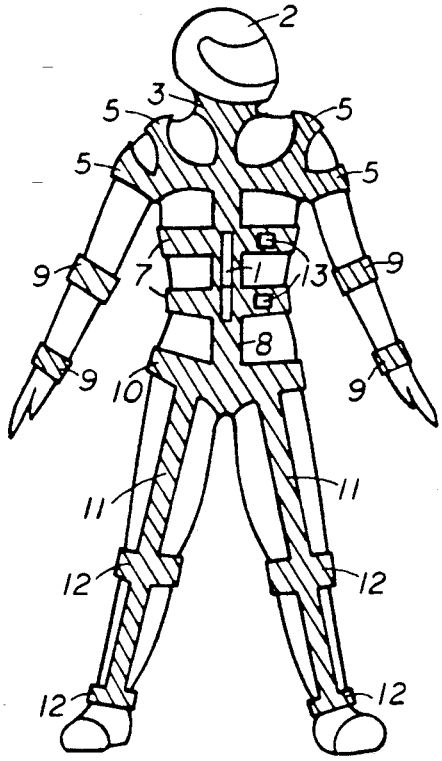
FIG. 2 is the front side view of the motorcyclist's body showing the arrangement of the uninflated air strips.
Figure 3:
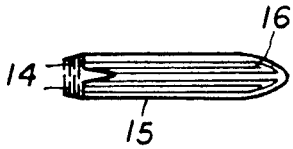
FIG. 3 is the cut-away view of the uninflated and pleated air strip.
Figure 4:
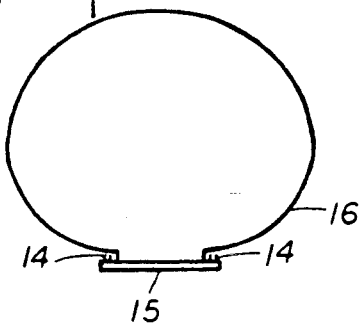
FIG. 4 is the cut-away view of the inflated air strip.

As shown in FIGS. 1 and 2, when uninflated, the strips are worn all around the motorcycle rider's body over the clothing. In this mode the air strips are pleated, as shown on FIG. 3, and their outer edges are sealed by self-adhesive means 14 which hold the edges firmly enough to prevent their opening due to air resistance or some other reason. As shown on FIG. 3, inner parts 16 of the air strips are pleated and when inflation occurs, together with outer parts 15 they form the air tube as shown on FIG. 4.

As shown in FIGS. 1 and 2, two vertical strips 8 are worn along the middle of the rider's torso covering the rider's backbone, chest, and stomach. The vertical strips 6 are worn along both arms covering the arms from the back side and the vertical strips 11 are worn along both legs covering their front side. The vertical strips 6 which cover the arms extend from the horizontal strip 4 which covers the upper back part of the rider's torso and the vertical strips 11 which cover the legs extend from the vertical strip 8 which covers the front part of the rider's torso. Since in almost every accident motorcycle riders fall on the back side of their arms and the front side of their legs, the vertical strips 6 and 11 are located as described above.

The horizontal strip 3 which covers the rider's neck is connected to both vertical strips 8. The horizontal strips 5 are provided to protect the rider's shoulders and the horizontal strips 9 cover the rider's elbows and wrists. The vertical strips 6 are not extended over the hands because of safety reasons. Namely, the rider's hands either have to be completely covered or will not provide any significant protection (which is not provided by gloves) and in the case of an incidental inflation completely covered hands may significantly limit maneuverability of the rider's hands and cause an accident. For the same reason the vertical strips 11 are not extended over the rider's feet. However, in most cases both rider's hands and feet will be partially protected by the inflated horizontal strips 9 and 12. The horizontal strips 7 and 10 are provided to protect the rider's torso and the horizontal strips 12 are provided around the rider's knees and ankles and connected on the vertical strips 11 as shown on FIG. 2.

Figure 5:
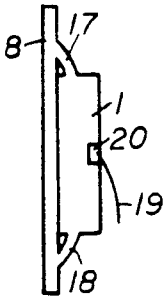
FIG. 5 is the side view of the inflator unit attached to the air strips.

The inflator unit 1, shown on FIGS. 2 and 5, is preferably attached in the strip 8 in the vertical position which enables the gas to be released through two diffuser exits 17 and 18 into the upper and lower portion of said strip 8. The diffuser exit 17 will enable the gas to inflate the upper air strips and the diffuser exit 18 will enable the gas to inflate the lower air strips. The inflator unit 1 may be similar to one commonly used to inflate driver's air bags in cars. The section of the air strip 8 where the inflator unit 1 is attached, FIGS. 2 and 5, has to be fabricated strong enough to hold the unit 1 which may weigh about 3 pounds. It is to be understood that any type of inflator 1, having any suitable weight and size can be used for the purpose of the invention.

The inflator unit 1 has to be attached to the strip 8 in a manner which ensures that the strip 8, when inflated is always between the unit 1 and the rider's torso. This will prevent contact between the unit and the rider's torso even in the case that the rider falls directly on his/her front torso. Furthermore, the inflator unit 1 may be attached to the strip 8 in a manner which will ensure that the unit 1 detaches from the strip as soon as the inflation process is completed. It is also to be understood that instead of the inflator unit 1 containing the gas propellant, as proposed for the preferred embodiment, some other system (such as compressed gas inflator) can be used for the purpose of the present invention.

As shown in FIG. 5, the inflator unit 1 is provided with the activator unit 20 and the activating cord 19. The activating cord 19 is extended from the activator unit 20 and during a ride attached to a connector unit (not shown on Figs.) provided on the motorcycle seat or on some other suitable position on the motorcycle. Since there may be a few possible modes to ignite the propellant, the physical structure of the activating cord 19 will depend on chosen ignition mode. If an initiator booster (which ignites the propellant) is ignited by an electrical current which is converted into heat by a resistor wire located in a squib assembly, the cord may be used either to activate the electric current from the battery provided in the inflator unit 1 or to supply the electric current from the motorcycle battery. In the second case the cord has to be fabricated in the form of a cable which is able to transmit the electrical current provided from the motorcycle battery through the contact section of the connector unit. If mechanical means are used to provide the ignition or the battery is provided in the inflator unit 1, the cord 19 can be made of simple rope which does not expand under pressure.

In order to prevent incidental inflation when the rider is to dismount the motorcycle, a sound unit is provided in the connector unit. The sound unit is connected on the motorcycle battery and beeps if there is any pressure exerted on the cord 19. This will warn the rider to detach the cord 19 before dismounting the motorcycle.

When released from the stowed condition the air strips extend in their full length. The rider may put them on according to the following procedure. First, the head is inserted through the horizontal strip 3 which is to be located around the neck. The rider then inserts his/her legs through the three horizontal strips 10 and 12 which are provided for protection of hips, knees and ankles. The arms are also inserted into the horizontal strips 5 and 9 which protect the shoulders, elbows, and wrists. The two horizontal strips 7 which are located around the upper stomach section and the chest are, preferably, not directly connected to the front vertical strip 8 with one of their ends, in order to enable comfortable and efficient putting on of the strips. The ends of these two horizontal strips 7 are provided with the clasps 13, as shown on FIG. 2. The clasps 13 have to be manually attached to the hooks provided on the opposite ends of the strips When the rider locks the clasps 13 he/she mounts the motorcycle and attaches the activating cord 19 to the connecting unit on the motorcycle. If no accident occurs, at the end of the ride the rider detaches the activating cord 19 from the connecting unit. As soon as the rider stands up the pressure exerted on the cord 19 activates the sound unit to warn the rider to detach the cord 19. It is assumed that means are provided to adjust the cord's length according to an individual rider's height in order to provide the warning and prevent an incidental inflation.

Since in a vast majority of motorcycle accidents the rider(s) separates from the motorcycle, it is assumed that the present invention will act as described hereinafter. When the motorcycle hits an obstacle or the rider loses control he/she will separate from the motorcycle. When the rider separates from the motorcycle for a certain predetermined distance, the pressure exerted on the activating cord 19 will activate the inflation process. The most simple and preferred mode is that the cord 19 detaches from the inflator unit 1 and produces ignition by mechanical means. It also may enable an electric signal from the inflator battery to produce heat in the squib or provide an electric signal from the motorcycle battery.

The ignited booster ignites the propellant which produces a specified volume of gas which is then discharged through the diffuser exits 17 and 18 into the air strips. The gas inflates the air strips and causes them to form the air tubes, as shown on FIG. 4, all around the rider's body. Since about 3 cubic feet of gas will be required to inflate the entire length of the air strips in the volume of about 1,5 inch in radius and since this process will not require longer than 70 milliseconds, it is assumed that the entire length of the air strips will be inflated to a certain predetermined pressure before the rider's body touches the pavement. It is also assumed that the inflation process has to be performed in a manner which will allow as much time as possible for stripes' deployment in order to make said deployment less abrupt.

Furthermore, it is assumed that the inflator unit 1 must function in a controlled and reproducible manner and produce cool, non-toxic, and non-flammable gas. Regarding firmness of the inflated air strips, it is assumed that they are inflated to a pressure which will provide as good as possible protection and will not result in unacceptable rebound. When inflated to about 3 inches in diameter, the air strips will cover almost the entire rider's body and provide the protection for the most vital parts. Since most injuries are caused because of sliding or rotating on the pavement, or hitting an obstacle after sliding or rotating, it is assumed that the present invention will significantly improve riding safety and significantly diminish the number of injuries in motorcycle accidents.

It is to be mentioned that different methods can be used for venting the air strips but the preferred method is to leave part of the material uncoated along the edges of the strips which cover the wrists 9 and ankles 12.

It is to be understood that the present invention has been described in relation to the particular embodiment, herein chosen for the purpose of illustration and that the claims are intended to cover all changes and modifications, apparent to those skilled in the art, which do not constitute departure from the scope and spirit of the invention.

What is claimed is:

1. An easily stowable protective device which can be worn over a cyclist's clothing while riding a cycle, the device being activated in the event of an accident to protect the body of the cyclist, the protective device comprising:

a gas generating source of pressurized gas including at least one fluid outlet;

an activator cord having first and second cord ends, the first cord end being attachable to the source of pressurized gas and the second cord end being attachable to the cycle whereby if the cyclist is thrown from the cycle, the source of pressurized gas is activated so as to release pressurized gas into the fluid outlet;

a first longitudinal torso protecting inflatable air strip adapted to extend longitudinally along the cyclist's torso;

at least three lateral torso protecting air strips spaced from one another and extending from the first longitudinal torso protecting air strip; said lateral torso protecting strips adapted to encircle the cyclist's torso;

two longitudinal leg protecting air strips extending downward from one of the lateral torso protecting strips, each of the longitudinal leg protecting air strips adapted to extend along one of the cyclist's legs;

at least two lateral leg protecting strips spaced from one another and extending from the longitudinal leg protecting strips, each of the lateral leg protecting strips adapted to encircle one of the cyclist's legs;

at least two longitudinal arm protecting air strips in fluid communication with the torso protecting strips, each of the longitudinal arm protecting air strips adapted to extend along one of the cyclist's arms;

at least two lateral arm protecting strips extending from each of the longitudinal arm protecting strips, the lateral arm protecting strips being spaced from one another and each of the lateral arm protecting strips adapted to encircle a portion of the cyclist's arm;

all of the air strips being in unrestricted fluid communication with one another and said fluid outlet of source of pressurized gas being in fluid communication with the air strips so as to provide pressurized gas to said air strips for inflating said air strips into air tubes for protecting the cyclist; the air strips being connected to one another so that they can be worn over the cyclist's clothing and each air strip defining a substantially fluid tight air passage, each air strip being substantially flattened in its uninflated state and inflatable into said air tube shape when pressurized gas is introduced into the substantially fluid tight air passage and wherein a plurality of open spaces are provided between the air strips so that the air strips have a compact easily stowable design.

2. The protective device of claim 1, further comprising a lateral neck protecting air strip extending from a first longitudinal torso protecting air strip, the neck protecting air strip adapted to encircle the cyclist's neck.

3. The protective device of claim 1, further comprising a plurality of shoulder protecting strips spaced from one another and extending from one of the lateral torso protecting strips and wherein the longitudinal arm protecting strips are connected to the lateral torso protecting strips through the shoulder protecting strips.

4. The protective device of claim 1, wherein each of the air strips comprise pleated strips which are joined together so as to allow the flow of gas through their entire length.

5. The protective device of claim 1, wherein each of the air strips comprise pleated inner parts, outer edges and self adhesive means holding the outer edges together.

6. The protective device of claim 1, wherein the source of pressurized gas is an inflator type gas generating unit secured to one of the longitudinal torso protecting strips.

7. The protective device of claim 1, wherein the protective device has a compact construction so that it can be stored in a small compartment such as the inside of a motorcycle helmet.

8. The protective device of claim 1, further comprising:

at least two manually operated clasps for providing a connection between adjacent strips.

9. The protective device of claim 1, wherein at least one of the longitudinal torso protecting strips includes means for secure attachment of said gas generating source of pressurized gas to said air strips.

10. An easily stowable compact protective device which can be worn over the clothing of a cyclist while riding a cycle so as to protect the cyclist in the event of an accident, the protective device comprising:

a skeletal network of distinct interconnected air strips comprising a plurality of distinct air strips spaced so as to define empty spaces between the air strips so as to reduce the volume of the device such that the network of air strips can be worn over the cyclist's clothing and stowed in a small area such as a cyclist's helmet when not n use, the air strips including a plurality of air strips adapted to encircle the cyclist's torso, a plurality of distinct air strips adapted to encircle the cyclist's legs and a plurality of distinct air strips adapted to encircle the cyclist's arms; the torso protecting air strips, the leg protecting air strips and the arm protecting air strips being in unrestricted fluid communication with one another;

a gas generating source of pressurized gas having a fluid passage in fluid communication with one of the air strips, an activator means for initiating generation of pressurized gas by the source of pressurized gas for release into the network of air strips in response to a sensed condition so as to inflate the network of air strips into air tubes so as to protect the cyclist.

11. The protective device of claim 10, wherein each of the air strips has at least two edges spaced from the other air strips such that the air strips are spaced from one another so as to provide a skeletal network of interconnected air strips.

12. The protective device of claim 10, wherein each of the air strips comprise pleated strips which are joined together so as to allow the flow of gas through their entire length.

13. The protective device of claim 10, wherein each of the air strips comprise pleated inner part, outer edges and self adhesive means holding the outer edges together.

14. The protective device of claim 10, wherein the source of pressurized gas is an inflator type gas generating unit secured to one of the longitudinal torso protecting strips.

15. The protective device of claim 10, wherein the protective device has a compact construction so that it can be stored in a small compartment such as the inside of a motorcycle helmet.

16. An easily stowable protective device for protecting the body of a cyclist in the event of an accident, the protective device comprising:

a gas generator source of pressurized gas including at least one fluid outlet;

an activation mechanism for initiating generation of pressurized gas by the source of pressurized gas in response to a sensed condition;

an interconnected network of air strips in fluid communication with one another which air strips can be worn over a cyclist's clothing, the network of air strips including a plurality of air strips adapted to encircle each of the cyclist's arms and legs, a plurality of air strips adapted to encircle the user's torso, at least one air strip extending along each of the user's arms and legs and at least two air strips extending along the user's torso;

the fluid outlet of the source of pressurized gas being in fluid communication with the network of air strips such that when the source of pressurized gas is activated by the activating means, pressurized gas is released into the network of air strips such that the air strips are inflated into air tubes so as to protect the cyclist; and wherein the network of air strips are spaced apart such that the air strips can be compacted so that the air strips, the source of pressurized gas and the activating means are compact enough to be stored inside a small compartment such as a helmet.

17. The protective device of claim 16, wherein each of the air strips has at least two edges spaced from the other air strips such that the air strips are spaced from one another so as to provide a skeletal network of interconnected air strips.

18. The protective device of claim 16, wherein each of the air strips comprise pleated strips which are joined together so as to allow the flow of gas through their entire length.

19. The protective device of claim 16, wherein each of the air strips comprise pleated inner parts, outer edges and self adhesive means holding the outer edges together.

20. The protective device of claim 16, wherein the source of pressurized gas is an inflator type gas generating unit secured to one of the longitudinal torso protecting strips.

* * * * *